US007608021B1

(12) United States Patent
Nalley

(10) Patent No.: US 7,608,021 B1
(45) Date of Patent: Oct. 27, 2009

(54) WEIGHT PLATE WITH EXTERNALLY ACTUATED INTERNAL LOCKING DEVICE

(76) Inventor: Mark Nalley, 41373 Avenida Delores, Murrieta, CA (US) 92562-7368

( * ) Notice: Subject to any disclaimer, the term of this patent is extended or adjusted under 35 U.S.C. 154(b) by 459 days.

(21) Appl. No.: 11/349,101

(22) Filed: Feb. 8, 2006

(51) Int. Cl.
*A63B 21/062* (2006.01)

(52) U.S. Cl. ..... 482/98; 482/99

(58) Field of Classification Search ..... 482/92–94, 482/98–103, 106–108, 104–109
See application file for complete search history.

(56) References Cited

U.S. PATENT DOCUMENTS

| | | | | | |
|---|---|---|---|---|---|
| 772,906 | A * | 10/1904 | Reach | 482/98 |
| 848,272 | A * | 3/1907 | Thornley | 482/102 |
| 1,052,962 | A * | 2/1913 | Reach | 482/102 |
| 1,053,109 | A * | 2/1913 | Reach | 482/99 |
| 1,752,412 | A * | 4/1930 | Blickman | 482/90 |
| 2,632,645 | A * | 3/1953 | Barkschat | 482/38 |
| 3,614,097 | A * | 10/1971 | Blickman | 482/72 |
| 5,123,885 | A * | 6/1992 | Shields | 482/106 |
| 5,344,375 | A * | 9/1994 | Cooper | 482/106 |
| 5,374,229 | A * | 12/1994 | Sencil | 482/98 |
| D519,173 | S * | 4/2006 | Nalley | D21/680 |
| 7,179,208 | B1 * | 2/2007 | Nalley | 482/99 |
| 7,435,206 | B1 * | 10/2008 | Nalley | 482/106 |
| 7,473,211 | B2 * | 1/2009 | Lee | 482/97 |
| 2007/0004569 | A1 * | 1/2007 | Cao | 482/94 |
| 2007/0243976 | A1 * | 10/2007 | Cao | 482/94 |
| 2008/0305936 | A1 * | 12/2008 | Cao | 482/98 |
| 2009/0048079 | A1 * | 2/2009 | Nalley | 482/107 |

* cited by examiner

*Primary Examiner*—Loan H Thanh
*Assistant Examiner*—Victor K Hwang
(74) *Attorney, Agent, or Firm*—Morland C. Fischer

(57) ABSTRACT

A weight plate for use with physical fitness equipment is disclosed including a plate body with a centrally located locking connector and two outwardly disposed throughbores. The body additionally has an internal bore within the thickness of the plate body which communicates with the locking connector. A selector pin is movably mounted within the internal bore to selectively engage the plate body to a locking connector in an adjacent weight plate. A toggle lever is mounted in a cartridge mounted within the weight plate to selectively position the selector pin.

16 Claims, 5 Drawing Sheets

WEIGHT PLATE WITH EXTERNALLY ACTUATED INTERNAL LOCKING DEVICE

BACKGROUND

1. Field of the Invention

This invention relates to a weight plate for use with body building equipment, in general, and, more particularly, to a weight plate having a cartridge therein which includes an external toggle lever which actuates an internal mechanical pin to conveniently, safely and simply engage a connection union mounted in or adjacent weight plates.

2. Prior Art

Body building equipment (also referred to as physical fitness equipment or exercise apparatus) often takes many forms to provide the resistance necessary to tear down muscle tissue during an exercise regimen. Many ingenious resistance developing systems or machines have been developed utilizing, for example, systems which incorporate a selectable weight stack. By design, the known equipment allows a user to, within the module, increase weight as the available resistance is incrementally selectable. These systems often promise faster and better results for exercisers. However, despite the advancement of mechanical and/or biomechanical devices which may benefit muscle growth, little effort has been made to simplify and/or make the selectable weight stack safer.

Conventional weight stacks are, typically, multiple layers of metal-based plates which collectively and, generally, amass an aggregate gross amount of weight. Generally, a weight stack includes a plurality of rectangular weight plates, typically about one inch thick and about 10 inches long by 4 inches wide. Each conventional plate incorporates four bore holes therein. Three throughbores pass vertically through the thickness of the plate from the top surface to the bottom surface. The fourth bore hole passes horizontally within the width of the plate (between the top and bottom surfaces) and intersects the middle one of the three vertical bore holes. Two throughbores engage or receive a pair of spaced-apart guide rods and cause the plate to track vertically thereon.

The middle throughbore accommodates a center post. The typical center post has multiple diametric throughbores to receive a selector pin which passes through the fourth throughbore. Thus, each plate may be independently selected by way of manually inserting a selector pin which is, typically, slightly longer than the width of a plate and has a knob of sorts on one end so that a user may better manipulate the selector pin. The pin is inserted through the fourth throughbore in the plate and a throughbore in the center post to lock the weight plate to the center post for selectively moving that weight plate vertically either up or down, as well as any weight plate supported thereon.

Although traditional weight stacks, such as those described above, have succeeded in carrying out the intended weight lifting purpose, there are many areas for substantial improvement.

One key problem often associated with traditional weight stacks is that the selector pin is removable and, as a result, is often misplaced, stolen or damaged whereupon it is replaced with a functionally and/or structurally inadequately sized pin. This inappropriate replacement historically has caused bodily injury when the system fails due to the violation of the inherent design of the apparatus.

The removable pin also permits the user to easily modify the operation of the apparatus outside the manufacturer's design criteria for the plates and/or weight stack.

Additionally, there is a level of dexterity and hand-to-eye coordination required to effect the insertion of the selector pin in the horizontal throughbore of the weight and the center post which further limits the true and effective result.

In other weight plates, latch levers are rotated at one of the surfaces of the weight plate to selectively engage a notch or groove formed in the center post or hanger bar as described in U.S. Pat. No. 5,306,221 to Itaru. These devices are subject to slippage of the levers unless an extremely complicated system of levers is utilized and precisely locked in position.

Yet other weight plates included sliding plates, described in U.S. Pat. No. 772,906 to Reach, which are cams formed in the weight plates to effectively engage lugs on an adjacent weight plate.

These latter devices are subject to large manufacturing costs and are cumbersome to use as well as having clear safety issues.

Therefore, the need exists for a more manufacturable weight plate having a construction that minimizes confusion on the part of the user, possibility for misuse or failure, yet retains the convenient exchange of weight with a single finger of a human hand. The weight plate of the present invention satisfies this need.

CO-PENDING APPLICATIONS

| | | |
|---|---|---|
| M. Nalley | WEIGHT PLATE WITH EXTERNALLY ACTUATED INTERNAL LOCKING DEVICE | Ser.No. 10/970,267 |
| M. Nalley | WEIGHT STACK APPARATUS | Ser.No. 29/227,244 |
| M. Nalley | WEIGHT STACK APPARATUS WITH INTERLOCKING DEVICE | Ser.No. 10/868,065 |

SUMMARY OF THE INVENTION

The weight plate of the present invention includes a convenient, integrally assembled cartridge with an exterior lever for enabling an internal pin to engage or disengage a connecting union which is attached to the plate.

A weight plate for physical fitness equipment is disclosed including a plate body with a central throughbore for connection and at least one, preferably two, throughbores which pass vertically therethrough for receiving guide rods or the like. The plate body additionally has an internal cavity which includes a horizontal bore disposed intermediate the opposing surfaces of the plate body. Typically, the horizontal bore intersects the central vertical throughbore. A selector pin is movably mounted within the cartridge and passes through the internal bore to selectively engage the plate body to a union or connector which is mounted is the central throughbore of the weight plate. A toggle lever is mounted in the cartridge to selectively position the selector pin within the internal bore. The union (or connector) is adapted to fit snugly within the central throughbore and includes a radial or diametric opening therethrough to selectively engage the selector pin from the cartridge.

The connector comprises a generally stepped conical or cylindrical-pyramidal shape with an end latching eye at one end thereof and an open center thereof to receive the end latching portion of a similar connector therein such that a selection pin engages the union connector body in the weight plate as well as the latching eye of the union in an adjacent weight plate. Thus, the cartridge selector pin is selectively operative to join a weight plate to an adjacent weight plate or a lift apparatus cable or the like.

DESCRIPTION OF A PREFERRED EMBODIMENT

Figure 1:
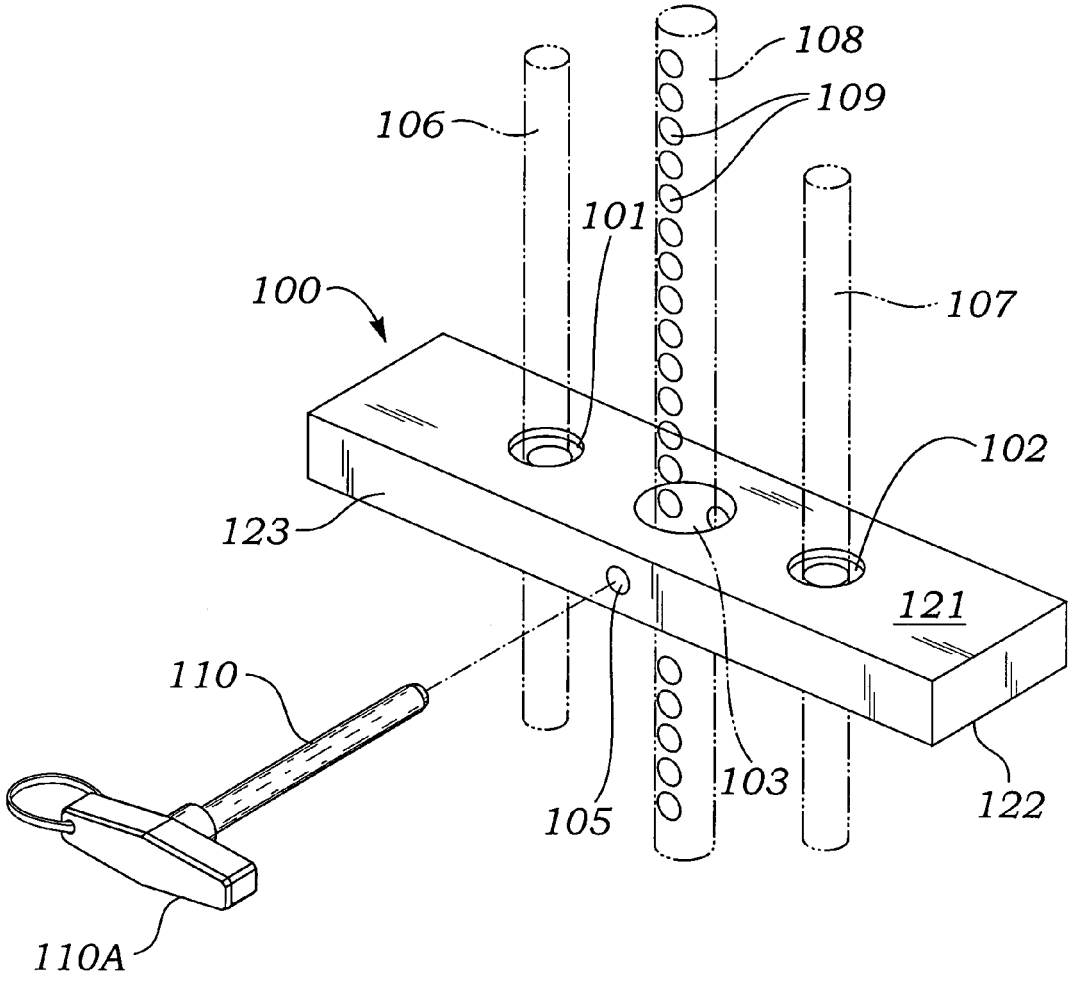
Fig. 1 (PRIOR ART)
FIG. 1 is a partially exploded, perspective view of a weight plate assembly known in the prior art.

Referring now to FIG. 1, there is shown a conventional weight plate 100 which is known in the art. Typically, multiple weight plates are used to collectively amass an aggregate gross weight in a weight machine. Generally, a conventional weight plate 100 comprises a rectangular body, typically about one inch thick and about 10 inches long by 4 inches wide. Conventional weight plates incorporate three vertical throughbores 101, 102 and 103 which pass through the thickness of the plate from the top surface 121 to the bottom surface 122. A fourth throughbore 105 passes horizontally through the plate (from the front 123 toward the back between the top and bottom surfaces) and intersects the middle throughbore 103.

In a typical utilization, throughbores 101 and 102 receive a pair of conventional spaced apart guide rods 106 and 107 (shown in dashed outline). This arrangement permits the plate 100 to track vertically on the guide rods.

The middle throughbore 103 accommodates a center post 108 also shown in dashed outline. The center post 108 has multiple diametric throughbores 109 to act as a receptacle for a selector pin 110 which passes through throughbore 105. Each plate 100 may be independently selected by way of manually inserting the selector pin 110 through throughbore 105 and a throughbore 109 in the center post 108 (after moving the weights or the center post vertically up or down) to select a desired weight plate. Selector pin 110 is, typically, slightly longer than the front-to-back width of any one plate and has a suitable knob 110A at one end so that a user may better manipulate the pin.

Although conventional weight stacks, such as those described above, have succeeded in carrying out the intended purpose, there are many areas for substantial improvement. For example, the proper selector pin 110 is frequently misplaced and replaced with a functionally and/or structurally inadequately sized pin. Historically, this inappropriate replacement has caused bodily injury due to the inherent design flaw of the pin which is permitted as a result of the freedom of user to openly circumvent the manufacturer's weight stack design.

Additionally, inasmuch as there is a certain level of dexterity and hand-to-eye coordination required—as well as attention to task—to effect the "engagement" of the selector pin 110 in the throughbore 105 of the weight which further limits the true and effective result. That is, failure to properly insert the selector pin may result in failure of the weight system and possible injury.

Figure 2:
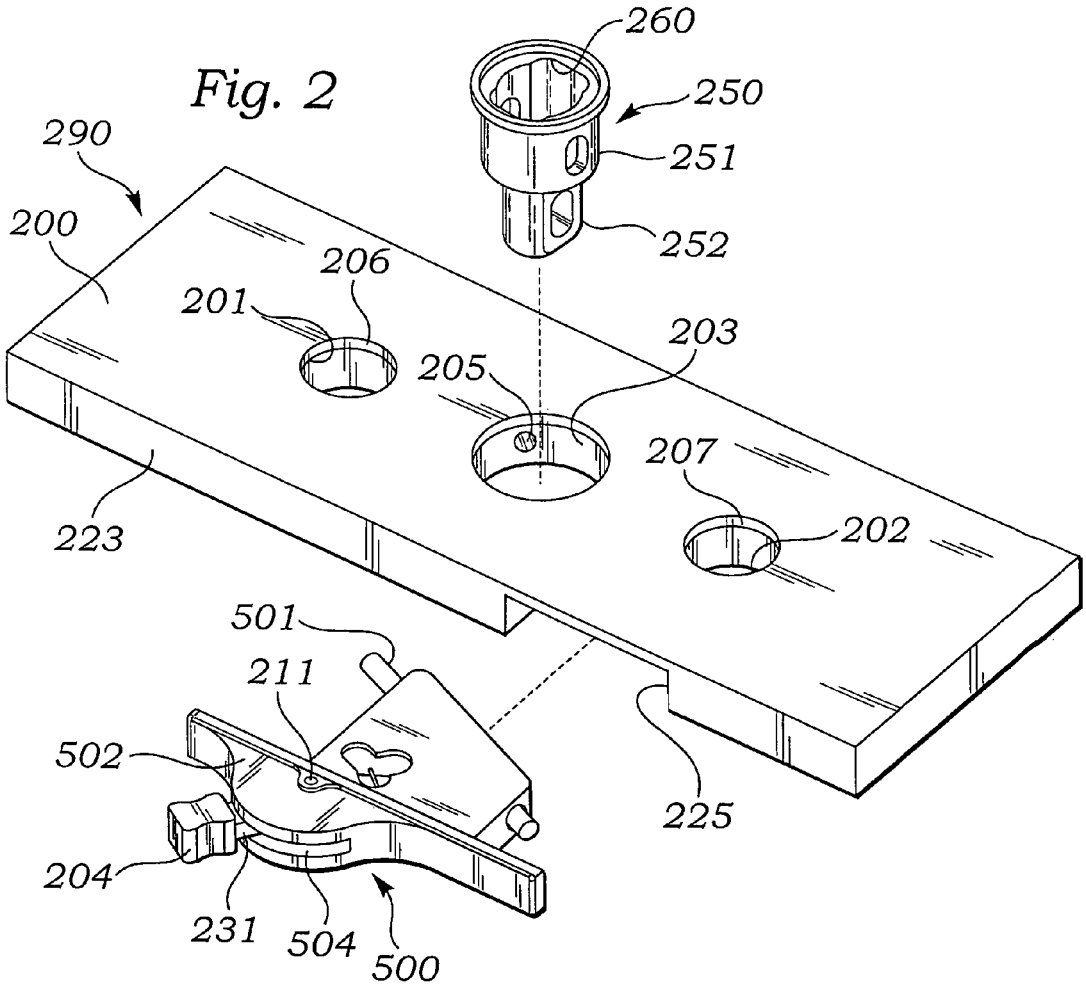
FIG. 2 is an exploded view of the weight plate apparatus of the instant invention.

Referring now to FIG. 2, there is shown an exploded view of the weight plate apparatus 290 of the instant invention. The plate 200 has the traditional rectangular configuration and is formed from a rigid material, such as iron, steel, urethane, rubber, plastic or a composite material. As an example, a weight plate may have a dimension of 10 inches long by 4 inches wide by 1 inch thick. These dimensions are illustrative only and are not limitative. The shape and size of the plate are subject to design preference.

The plate 200 is similar to the prior art weight plate formed with a middle or central throughbore 203 and two adjacent throughbores 201 and 202. The throughbores 201 and 202 (which may include low friction type bearings 206 and 207, respectively) receive the vertical guide bars (see bars 106 and 107 in FIG. 1) which stabilize the selected plate. However, in this invention, the middle throughbore 203 is adapted to accept a pin receiving connector union 250 which is described infra.

The plate 200 is further formed with an internal cavity 225 at the front edge surface 223 which receives and houses a locking cartridge 500 therein. The cartridge 500 (see infra) is properly sized to permit movement of the toggle (or pin actuator) lever 231 in slot 504 when actuated by moving the end piece 204 at the external end thereof. The toggle lever 231 is pivotally mounted around pivot pin 211 which is inserted through suitable apertures in cartridge 225 and selectively moves a locking pin 501 (see infra) into aperture 205.

Figure 3:
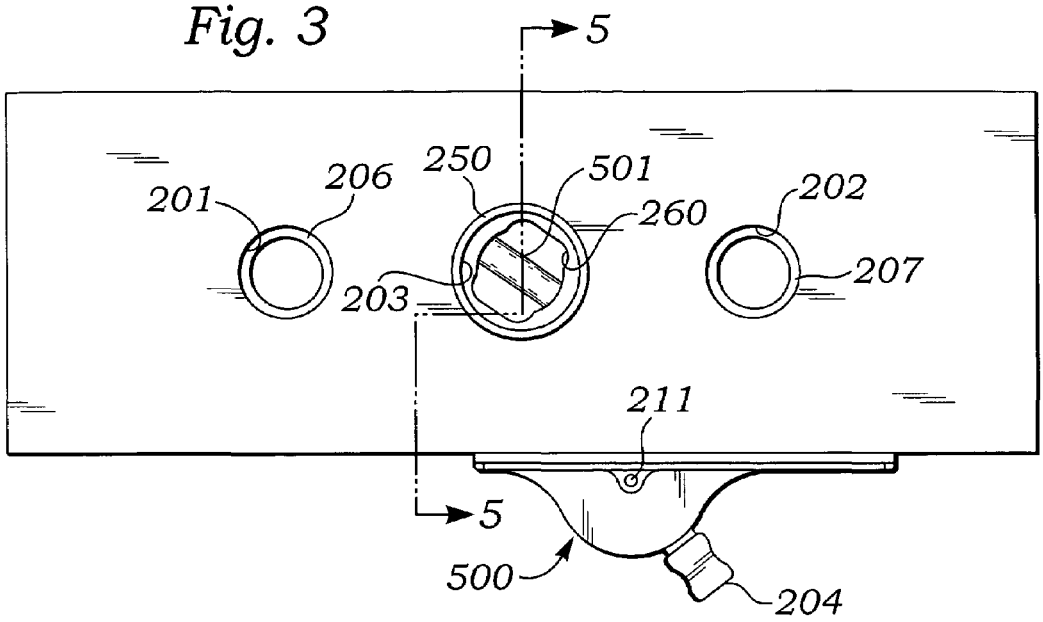
FIG. 3 is a plan view of the weight plate apparatus shown in FIG. 2 in the assembled condition with the locking pin in the locking position.
Figure 4:
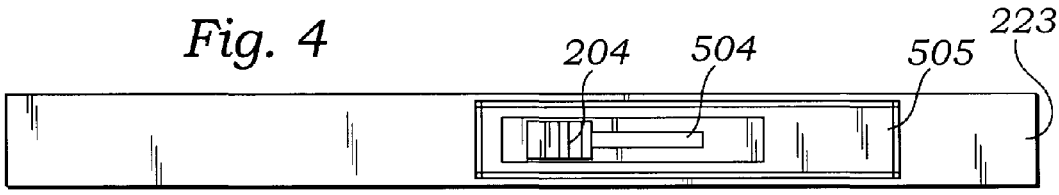
FIG. 4 is a front elevation view of the weight plate apparatus of the instant invention.

Referring concurrently now to FIGS. 3 and 4, there are shown a plan view and a front elevation view, respectively, of the weight plate 200.

The preferred rectilinear configuration of weight plate 200 is shown. The throughbores 201 and 202 are shown with the optional bearings 206 and 207 therein, respectively.

The throughbore 203 is shown with the connector 250 inserted therein. The upper surface 253 (see FIG. 5) of connector 250 is, typically, flush with the upper surface of the weight plate 200. The connector 250 is, typically, mounted by a force fit into the throughbore 203.

A cavity 260 is formed within the body 251 of the connector 250. The cavity is configured to receive the body portions 251 and 252 (see FIG. 2) of an adjacent connector 250 in an adjacent weight plate 200 or a weight cable end piece (not shown).

The cartridge 500 is inserted into the cavity 225 and mounted at the front surface 223 of plate 200. The toggle lever 231 moves through the slot 504 in the cartridge 500 and pivots about the pivot pin 211.

Figure 5:
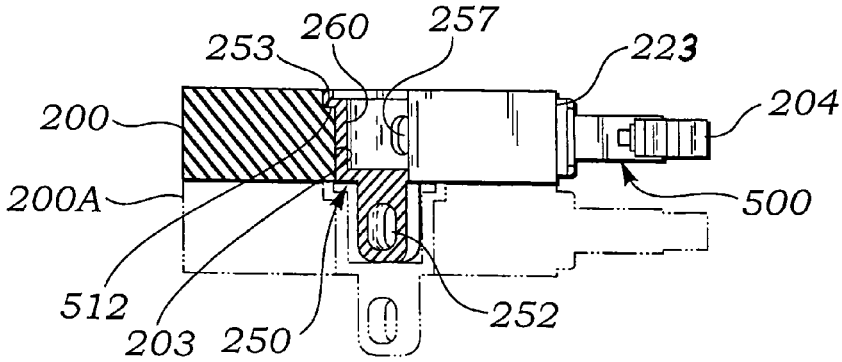
FIG. 5 is a partially broken away view of the weight plate apparatus of the instant invention taken along the line 5-5 in FIG. 3.

Referring now to FIG. 5, there is shown a partially broken away end view of the weight plate 200 with the union 250 mounted therein. As noted, this assembly may be created by a force fit.

It is seen that the upper surface of plate 200 is flush with the upper surface of union 250. The upper lip 253 of the union (or connector) 250 rests upon a shoulder 512 which is formed within the throughbore 203.

One side aperture of union 250, e.g., aperture 257 (see FIG. 8), is partially visible at the interior cavity 260 of the union 250. The lower interconnection loop 252 is seen protruding from the bottom of the weight plate 200.

As will be seen in FIG. 3, the locking pin 501 in a weight plate apparatus selectively passes through the cavity 260 and aperture 257 therein. In addition, this locking pin passes through the interconnection loop 252 in an adjacent plate 200A (shown in dashed outline) where it is placed in contact with the existing plate shown.

Figure 6:
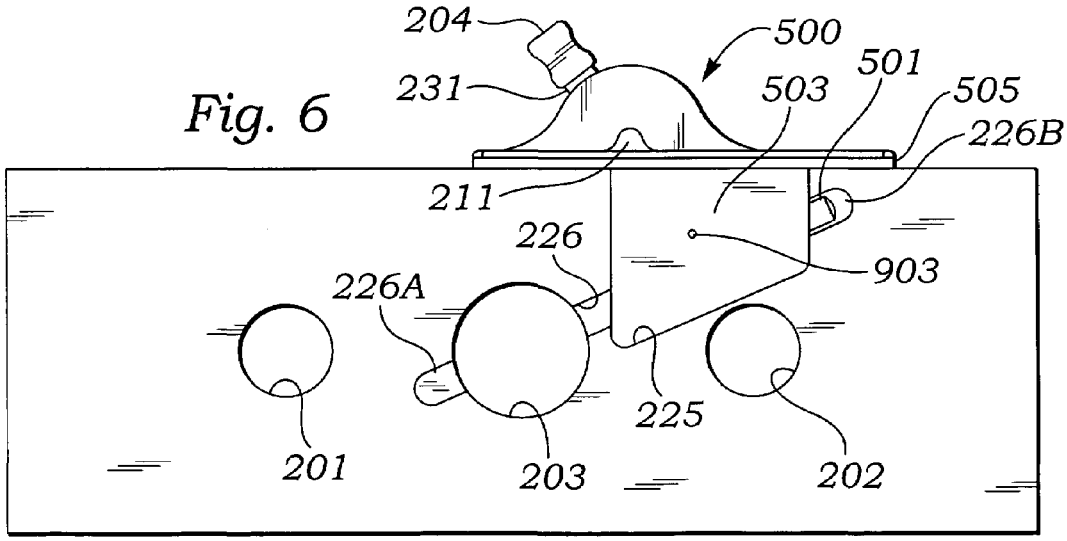
FIG. 6 is a partially broken away plan view of the bottom surface of the weight plate apparatus of the instant invention showing one embodiment of the cavity and cartridge with the locking pin retracted.

Referring now to FIG. 6 there is shown a bottom plan view of the weight plate apparatus 290 of the instant invention with the connector 250 omitted. The throughbores (or apertures) 201, 202 and 203 are depicted. The cavity 225 is shown communicating with the central throughbore 203 via internal bore 226 which receives locking pin 501 which is mounted in the cavity. Internal bore end 226A is adapted to receive the inner end of locking pin 501 (see FIG. 3) after it has passed through the apertures 256 and 257 in the body of connector union 250. Bore 226B is also adapted to receive the outer end of locking pin 501 when the locking pin is withdrawn from the locked position.

Figure 9:
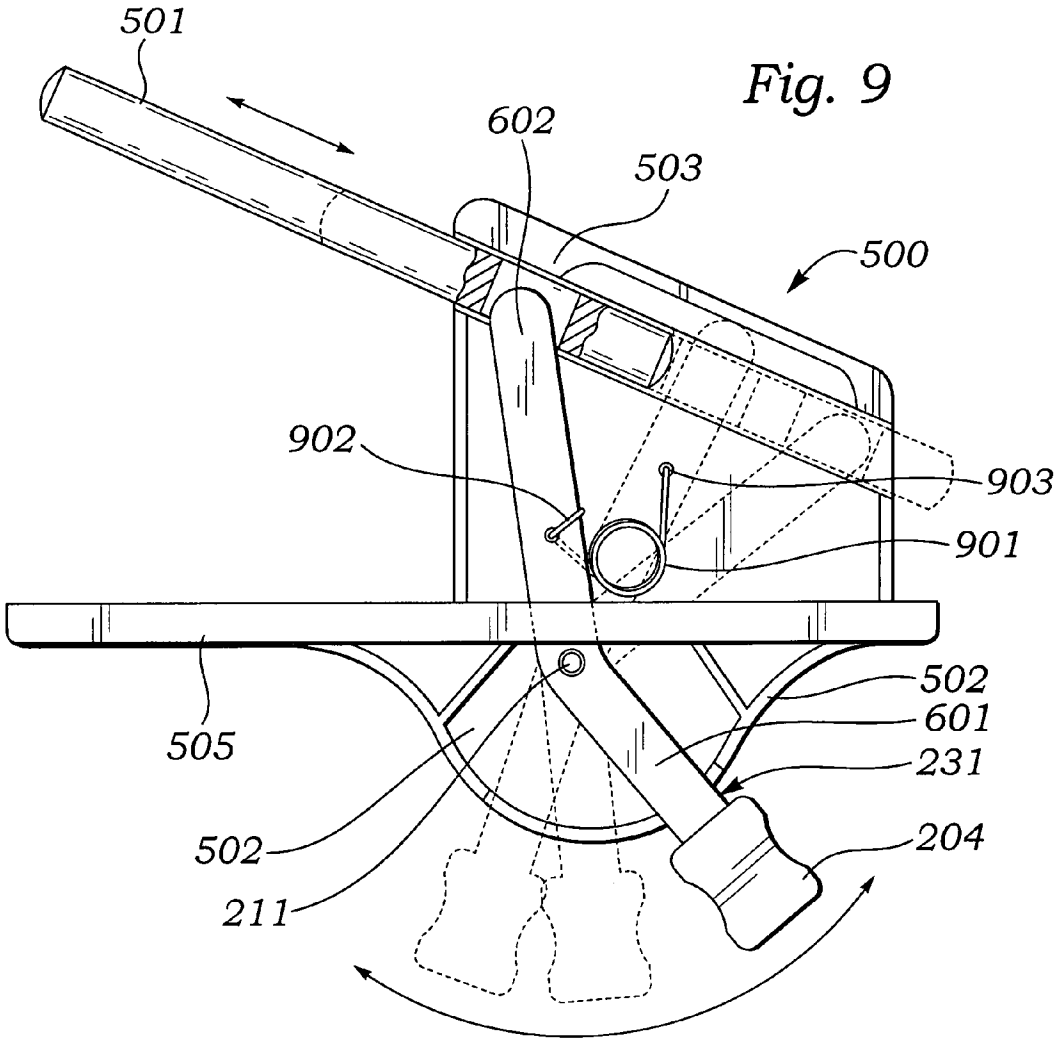
FIG. 9 is an enlarged perspective view of the cartridge of the weight plate apparatus of the instant invention with the locking pin shown in several positions.

Conversely, when lever 231 is moved to the right (as shown in FIG. 9) in slot 504 and internal cavity 225, the locking pin 501 is passed through aperture 203 (and the connector 250 when inserted in the aperture) to securely engage another connector union 250 in an adjacent weight plate 200 or a lift cable connector (as suggested in FIG. 2)

Figure 8:
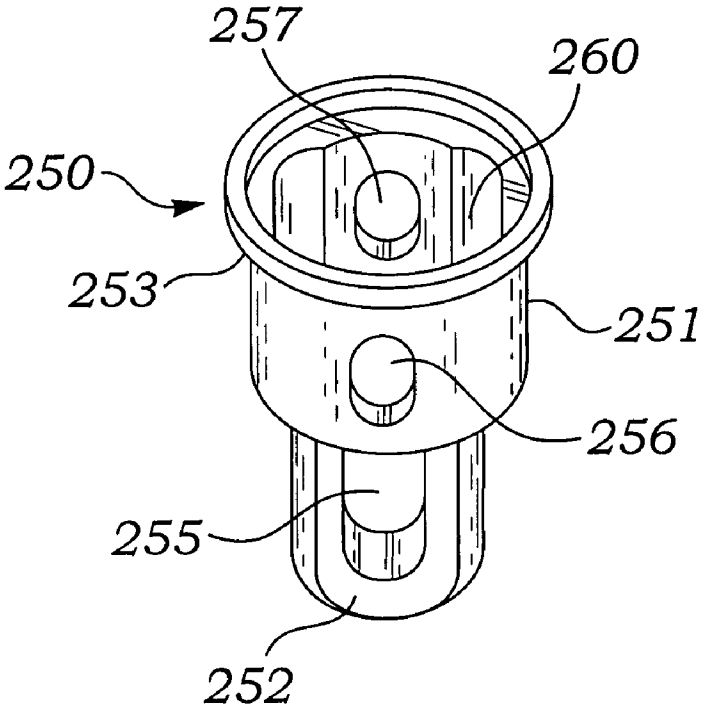
FIG. 8 is another view of the connector portion of the weight plate assembly of the instant invention rotated 90° relative to FIG. 7.
Figure 7:
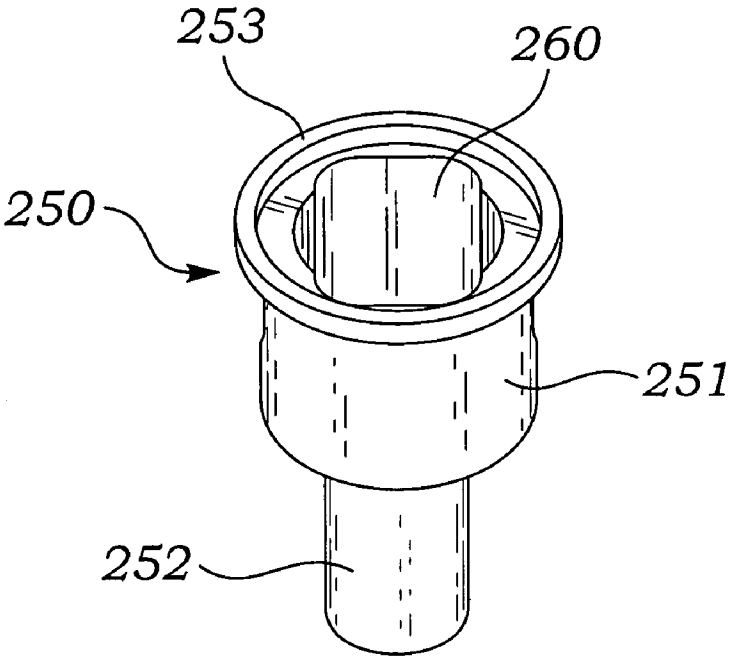
FIG. 7 is an enlarged perspective view of the connector portion of the weight plate assembly of the instant invention.

Referring concurrently to FIGS. 7 and 8, there are shown perspective views of the connector unit 250 of the instant invention.

In each of these views, the connector 250 is seen to have a generally cylindrical body 251 which has an outer diameter approximately 1¼ inches and a height of approximately 1 inch. These and any other dimensions described herein are not limitative but are representative only. The body 251 also includes an axial cavity 260 which is somewhat elliptical in configuration.

Apertures 256 and 257 are diametrically opposed to each other and pass through the side walls of the body 251 so as to communicate with the cavity 260 in the body 251.

At the upper end of body 251, the connector 250 includes a rim or lip 253. The lip 253 is approximately ⅜ inch thick and extends radially about ⅛ inch from the outer surface of the body 251. The lip 253 surrounds the body 251 and extends about ⅛ inch above the top surface of body 251.

At the lower end of body 251, the connector 250 includes a connector loop 252 which is somewhat elliptical in cross-sectional shape. The loop 252 extends about 1 inch below the lower end of the body 251 and includes aperture 255 therethrough.

Loop 252 of connector 250 in a first weight plate is adapted to be received into the cavity 260 of an adjacent connector 250 in a second weight plate of similar design. Thus, a plurality of weight plates in accordance with the instant invention can be selectively engaged.

Referring now to FIG. 9, there is shown an enlarged representation of the cartridge 500 as used in conjunction with the instant invention.

The cartridge 500 includes an external body 502 which includes an integrally formed front piece 505. The cartridge also includes an internal housing 503 attached to the opposite surface of the front piece 505. The front piece 505 is larger than the opening of cavity 225 and is mounted at the front surface 223 of the weight plate 200. The internal housing 503 is inserted into cavity 225 in the weight plate 200 (see FIG. 2). The body 503 is largely secured in the weight plate cavity 225 by friction force although fastening devices such as screws or an adhesive can be used.

The outer housing 502 is, typically, arcuate shaped and includes elongated slot 504 which passes horizontally through the outer surface therein. The slot 504 receives the toggle lever 231 as shown and described herein.

The toggle lever 231 is a generally planar component formed of a suitably strong material such as, but not limited to, stainless steel which inhibits rust and corrosion. The toggle lever 231 is somewhat angulated with planar body portions 601 and 602.

An aperture passes through the body portion 601 in a location (typically at or near the midpoint thereof) advantageously selected to permit proper pivotal rotation of the toggle lever 231 around the swage pin 211 which passes vertically through the body 502 of cartridge 500.

As noted supra, the inner end 602 of toggle lever 231 is inserted through the elongated slot 504 in the front panel 220 and engages a slot in locking pin 501. The locking pin 501 is, typically, made of a strong corrosion resistant material such as, but not limited to, stainless steel. The locking pin 501 is an elongated rod or shaft and is, typically, cylindrical in shape although other configurations are contemplated.

Thus, when toggle lever 231 is rotated around the pivot pin 211 by pushing on knob 204, the locking pin 501 is moved backward or forward within cartridge housing 503 as well as the cavities 226, 226A and 226B in the weight plate 200 (see FIG. 6). As the locking pin moves, it is selectively engaged with or disengaged from the union connector which extends into the throughbore 203 to lock or unlock the weight plate 200 relative to an adjacent weight plate.

Coil spring 901 has end 902 thereof engaged with lever body portion 602 within internal housing 503. The other end 903 of coil spring 901 is engaged with the inner portion of internal housing 503, for example at the rear (or bottom) surface thereof as viewed in FIG. 6.

Coil spring 901 assures that toggle lever 231 assumes one position (engaged) or the other (disengaged) and prevents the lever from remaining in an indefinite, half-way position. Thus, a fail safe operation is enforced.

While the invention has been particularly shown and described with reference to the preferred embodiments thereof, it will be understood by those skilled in the art that various changes in form and detail may be made therein without departing from the spirit and scope of the invention.

Thus, there is shown and described a unique design and concept of a weight plate with externally actuated internal locking device. Those skilled in the art will appreciate the many benefits and advantages afforded the present invention. Of significant importance is the ability to easily and safely select a desired weight without need for a center post while maintaining the advantage of providing an integrally formed and uniform system to reduce cost and liability exposure to the consumer. While this description is directed to particular embodiments, it is understood that those skilled in the art may conceive modifications and/or variations to the specific embodiments shown and described herein. Any such modifications or variations which within the purview of this description are intended to be included therein as well. It is understood that the description herein is intended to be illustrative only and is not intended to be limitative. Rather, the scope of the invention described herein is limited only by the claims appended hereto.

The invention claimed is:

1. Physical fitness apparatus, comprising:

a first weight plate having a bore hole formed vertically therethrough and an internal bore running transversely therein and communicating with said bore hole;

a second weight plate to be detachably connected to said first weight plate and having a bore hole formed vertically therethrough and an internal bore running transversely therein and communicating with said bore hole;

a first connector located in the bore hole through said first weight plate and a second connector located in the bore hole through said second weight plate;

each of the first and second connectors of said first and second weight plates having a hollow head at one end thereof and an aperture formed in said hollow head and axially aligned with a respective one of the internal bores in said first and second weight plates, each of said first and second connectors also having a coupling tail located at the opposite end thereof and a coupling hole formed in said coupling tail, the coupling tail of the first connector located in the bore hole of said first weight plate extending below said first weight plate for receipt within the hollow head of the second connector located in the bore hole of said second weight plate;

a locking pin mounted for reciprocal movement between unlocked and locked positions within the internal bore of each one of said first and second weight plates, said locking pin having a locking slot formed therein; and a lever arm communicating with each locking pin of each one of said first and second weight plates at the locking slot formed in said locking pin, each lever arm moving between a first position and a second position to correspondingly apply one of a pushing force or a pulling force to said locking pin, the lever arm which communicates with the locking pin of said second weight plate moving from the first position to the second position to exert the pushing force on said locking pin at said locking slot thereof and thereby cause said locking pin to move from said unlocked position to said locked position and ride through the internal bore in said second weight plate for receipt by the aperture formed in the hollow head of said second connector and the coupling hole formed in the coupling tail of said first connector received by the hollow head of said second connector, whereby said first weight plate is detachably connected to said second weight plate.

2. The physical fitness apparatus recited in claim 1, further comprising a spring cooperating with each lever arm communicating with each locking pin of each one of said first and second weight plates for exerting a force on said lever arm for holding said lever arm in one of said first or second positions.

3. The physical fitness apparatus recited in claim 2, wherein said spring is a coil spring.

4. The physical fitness apparatus recited in claim 2, further comprising a locking cartridge having a cartridge body attached to said second weight plate, the lever arm which communicates with the locking pin of said second weight plate being surrounded by said cartridge body and moving between said first and second positions therewithin, one end of said spring connected to said lever arm and the opposite end of said spring connected to said cartridge body.

5. The physical fitness apparatus recited in claim 4, wherein said second weight plate has a cartridge cavity extending inwardly thereof, the cartridge body of said locking cartridge being received within said cartridge cavity.

6. The physical fitness apparatus recited in claim 4, further comprising a pivot connected between the lever arm which communicates with the locking pin of said second weight plate and the cartridge body of the locking cartridge of said second weight plate, said lever arm rotating at said pivot within said cartridge body between said first and second positions to correspondingly apply said pushing and pulling forces to the locking pin of said second weight plate to cause said locking pin to move between said locked and unlocked positions.

7. The physical fitness apparatus recited in claim 4, wherein one end of said lever arm surrounded by the cartridge body of the locking cartridge of said second weight plate is received within the locking slot formed in the locking pin of said second weight plate, and the opposite end of said lever arm extends outwardly from said cartridge body at which to receive a force for causing said lever arm to move to one of said first or second positions.

8. The physical fitness apparatus recited in claim 7, wherein the cartridge body of the locking cartridge of said second weight plate has a guide slot formed therein for receipt of the opposite end of said lever arm, said opposite end moving back and forth through said guide slot for causing said lever arm to move between said first and second positions.

9. The physical fitness apparatus recited in claim 1, wherein said first and second weight plates are detachably connected in opposing face-to-face engagement one against the other.

10. Physical fitness apparatus, comprising:

a first weight plate having a bore hole formed vertically therethrough and an internal bore running transversely therein and communicating with said bore hole;

a second weight plate to be detachably connected to said first weight plate and having a bore hole formed vertically therethrough and an internal bore running transversely therein and communicating with said bore hole;

a first connector located in the bore hole through said first weight plate and a second connector located in the bore hole through said second weight plate;

each of the first and second connectors of said first and second weight plates having a hollow head at one end thereof and an aperture formed in said hollow head and axially aligned with a respective one of the internal bores in said first and second weight plates, each of said first and second connectors also having a coupling tail located at the opposite end thereof and a coupling hole formed in said coupling tail, the coupling tail of the first connector located in the bore hole of said first weight plate extending below said first weight plate for receipt within the hollow head of the second connector located in the bore hole of said second weight plate;

a locking pin mounted for reciprocal movement between unlocked and locked positions within the internal bore of each one of said first and second weight plates;

a lever arm coupled to each locking pin of each one of said first and second weight plates and adapted to move between first and second positions; and a spring cooperating with each lever arm of each one of said first and second weight plates for exerting a force on said lever arm for holding said lever arm in one of said first or second positions and said locking pin in one of said unlocked or locked positions, the lever arm coupled to the locking pin of said second weight plate moving from the first position to the second position to cause said locking pin to move from the unlocked position to the locked position so as to ride through the internal bore in said second weight plate for receipt by the aperture formed in the hollow head of said second connector and the coupling hole formed in the coupling tail of said first connector received by the hollow head of said second connector, whereby said first weight plate is detachably connected to said second weight plate.

11. The physical fitness apparatus recited in claim 10, further comprising a locking cartridge having a cartridge body attached to said second weight plate, the lever arm which is coupled to the locking pin of said second weight plate being surrounded by said cartridge body and moving between said first and second positions therewithin, one end of said spring connected to said lever arm and the opposite end of said spring connected to said cartridge body.

12. The physical fitness apparatus recited in claim 11, wherein said second weight plate has a cartridge cavity extending inwardly thereof, the cartridge body of said locking cartridge being received within said cartridge cavity.

13. The physical fitness apparatus recited in claim 11, further comprising a pivot connected between the lever arm which is coupled to the locking pin of said second weight plate and the cartridge body of the locking cartridge of said second weight plate, said lever arm rotating at said pivot within said cartridge body between said first and second positions to correspondingly apply pushing and pulling forces to said locking pin to cause said locking pin to move between said locked and unlocked positions.

14. The physical fitness apparatus recited in claim 13, wherein the locking body of the locking cartridge of said second weight plate has a guide slot formed therein for receipt therethrough of said lever arm, said lever arm moving back and forth through said guide slot for causing said lever arm to rotate between said first and second positions.

15. Physical fitness apparatus, comprising:

a first weight plate having a bore hole formed vertically therethrough and an internal bore running transversely therein and communicating with said bore hole;

a second weight plate to be detachably connected to said first weight plate and having a bore hole formed vertically therethrough and an internal bore running transversely therein and communicating with said bore hole;

a first connector located in the bore hole through said first weight plate and a second connector located in the bore hole through said second weight plate;

each of the first and second connectors of said first and second weight plates having a hollow head at one end thereof and an aperture formed in said hollow head and axially aligned with a respective one of the internal bores in said first and second weight plates, each of said first and second connectors also having a coupling tail located at the opposite end thereof and a coupling hole formed in said coupling tail, the coupling tail of the first connector located in the bore hole of said first weight plate extending below said first weight plate for receipt within the hollow head of the second connector located in the bore hole of said second weight plate;

a locking pin mounted for reciprocal movement between unlocked and locked positions within the internal bore of each one of said first and second weight plates; and a locking cartridge having a cartridge body attached to said second weight plate and a lever arm surrounded by and pivotally connected to said cartridge body so as to rotate therewithin between first and second positions, one end of said lever arm coupled to the locking pin of said second weight plate at a location within said cartridge body and the opposite end of said lever arm extending outwardly from said cartridge body at which to receive a rotational force to cause said lever arm to rotate between said first and second positions, said lever arm rotating from the first position to the second position to exert a pushing force on said locking pin to cause said locking pin to move in a first direction through the internal bore in said second weight plate from said unlocked position to said locked position to be received by the aperture formed in the hollow head of said second connector and the coupling hole formed in the coupling tail of said first connector received by the hollow head of said second connector, whereby said first weight plate is detachably connected to said second weight plate, said lever arm rotating from the second position to the first position to exert a pulling force on said locking pin to cause said locking pin to move in an opposite direction through the internal bore in said second weight plate from said locked position to said unlocked position to be removed from the aperture formed in the hollow head of said second connector and the coupling tail of said first connector received by the hollow head of said second connector, whereby said first weight plate is detached from said second weight plate.

16. The physical fitness apparatus recited in claim 15, wherein said first and second weight plates are detachably connected in face-to-face engagement one against the other.

* * * * *